US006354383B1

(12) United States Patent
Muilenburg

(10) Patent No.: US 6,354,383 B1
(45) Date of Patent: Mar. 12, 2002

(54) ATTACHMENT DEVICE FOR AN IMPLEMENT

(76) Inventor: Harold D. Muilenburg, 1310 Fourth St., Sheldon, IA (US) 51201

( * ) Notice: Subject to any disclaimer, the term of this patent is extended or adjusted under 35 U.S.C. 154(b) by 0 days.

(21) Appl. No.: 09/545,533

(22) Filed: Apr. 7, 2000

(51) Int. Cl.[7] ..... E02F 3/76

(52) U.S. Cl. ..... 172/817; 172/818; 172/395; 172/417; 172/484

(58) Field of Search ..... 172/684.5, 799.5, 172/395, 96, 417, 445.1, 484, 817, 818, 819, 824, 825; 37/268, 270, 271

(56) References Cited

U.S. PATENT DOCUMENTS

| | | | | |
|---|---|---|---|---|
| 2,724,314 A | | 11/1955 | Evans | |
| 2,818,664 A | | 1/1958 | Bond | |
| 4,044,843 A | | 8/1977 | Holub | |
| 4,049,062 A | | 9/1977 | Rossmiller et al. | |
| 4,073,346 A | | 2/1978 | Groth et al. | |
| 4,232,878 A | | 11/1980 | Moore, Jr. | |
| 4,326,594 A | | 4/1982 | Oka et al. | |
| 4,330,041 A | | 5/1982 | Ankenman | |
| 4,342,367 A | | 8/1982 | Gates | |
| 4,381,118 A | | 4/1983 | Weeks | |
| 4,490,929 A | | 1/1985 | Lucas | |
| 4,588,323 A | | 5/1986 | Vollmer et al. | |
| 4,674,578 A | | 6/1987 | Bexten et al. | |
| 4,700,784 A | | 10/1987 | Wiebe et al. | |
| 4,944,355 A | | 7/1990 | Karchewski | |
| 5,058,295 A | * | 10/1991 | Holland | 37/268 |
| 5,108,229 A | | 4/1992 | Slanker | |
| 5,172,499 A | | 12/1992 | Griffin | |
| 5,265,355 A | * | 11/1993 | Daniels | 37/231 |
| 5,349,911 A | | 9/1994 | Holst et al. | |
| 5,392,538 A | * | 2/1995 | Geerligs et al. | 37/268 |
| 5,397,200 A | | 3/1995 | Seal | |
| 5,497,716 A | | 3/1996 | Shoup | |
| 5,511,326 A | | 4/1996 | Liebrecht, Jr. | |
| 5,529,131 A | | 6/1996 | Van Ornum | |
| 5,715,892 A | * | 2/1998 | Foster | 172/200 |
| 5,785,128 A | | 7/1998 | Redekop | |
| 5,787,993 A | | 8/1998 | Hundeby et al. | |
| 5,794,711 A | * | 8/1998 | Slattery | 174/265 |
| 6,032,746 A | * | 3/2000 | Lowery | 172/445.1 |
| 6,102,132 A | | 8/2000 | Schimke | |
| 6,168,348 B1 | | 1/2001 | Meyer et al. | |

* cited by examiner

*Primary Examiner*—Victor Batson

(57) ABSTRACT

An attachment device for attaching an implement to an attachment plate for a vehicle. The attachment device includes at least two sets of two or more arms, each arm having a first end and a second end, the first end of each arm being operably coupled to the implement and the second end of each arm being operably coupled to the attachment plate, wherein the two sets of two or more arms allow the implement to be tilted such that a first end of the implement may be raised to a higher vertical position than a second end of the implement.

24 Claims, 13 Drawing Sheets

ATTACHMENT DEVICE FOR AN IMPLEMENT

TECHNICAL FIELD

This invention relates to devices and methods for connecting an implement with a vehicle or power source, such as a skid loader or a tractor.

BACKGROUND

A number of attachment devices have been designed to attach an implement, such as a grader, to a vehicle, such as a skid loader. A typical skid loader may be used with a number of implements, such as graders, box blades, mowing blades, or any other type of industrial or farm implement commonly used. An attachment plate can be obtained that may be used to to attach an implement to the skid loader. For common push-type implements, it is generally desirable to maintain a certain degree of control over the implement. For instance, it may be desirable to put downward pressure on the entire length of the implement. In addition, it may be desirable to raise one end of the implement above the other end of the implement to perform a particular function. For instance, if a mower blade is attached to the attachment plate of a skid loader, it may be desirable to raise one end or side of the mower blade above the other side of the mower blade so that an uneven cut of grass will result. If the implement is a box blade or grader, it may be desirable to achieve a slope or uneven grade of the ground, and hence one end or side of the blade may be in a higher vertical position than the other end of the blade.

U.S. Pat. No. 5,529,131 to Van Ornum issued on Jun. 25, 1996, describes one embodiment of a typical attachment device that may be used to raise or lower one end of an implement relative to the other end of the implement. The Van Ornum patent shows an attachment device in which an overarching beam passes from the loader's attachment plate, over the implement, and to a set of ground engaging wheels. The relative position of the implement may be altered in the Van Ornum device so that one end or side of the implement is higher than the other end or side of the implement.

Typical attachment devices for attaching implements to skid loaders, including the device described in the Van Ornum reference, have a number of disadvantages. First, typical attachment devices may be somewhat long and hence may be clumsy or difficult to maneuver in many situations. In the Van Ornum device, for instance, the set of ground engaging wheels extends a significant distance past the implement and the front end of the skid loader, which may make the skid loader and implement difficult to manipulate during operation. Second, it may be difficult to retain adequate and comfortable control over the skid loader while using the implement. In order to use the implement, a certain amount of downward pressure typically must be applied to the implement. In embodiments of attachment devices such as that shown in Van Ornum, it may be necessary to put a significant amount of pressure on the front ground engaging wheels, which may cause the front wheels of the skid loader to be lifted off the ground, hence putting pressure on the implement. This disengagement of the front wheels of the loader from the ground is not only uncomfortable for the operator of the skid loader, and it may also lead to decreased control of the loader. Most attachment devices, as noted above, may cause a number of undesirable side effects that may make it undesirable to use those attachment devices.

A need exists for an attachment device to attach an implement to a vehicle, such as a skid loader, that is maneuverable and that may be used to raise or lower one end or side of the implement relative to the other end, while still maintaining sufficient pressure on the implement. A need also exists for an attachment device that is strong and rigid enough for push-type applications and that is comfortable for the operator of the loader to handle.

SUMMARY

One embodiment of the invention is an attachment device for attaching an implement to an attachment plate for a vehicle. In this embodiment, the attachment device comprises at least two sets of two or more arms, each arm having a first end and a second end, the first end of each arm being operably coupled to the implement and the second end of each arm being operably coupled to the attachment plate, wherein the two sets of two or more arms allow the implement to be tilted such that a first end of the implement may be raised to a higher vertical position than a second end of the implement.

Another embodiment of the invention is an attachment device for attaching a blade to an attachment plate for a loader. In this embodiment, the attachment device comprises a first set of arms, the first set of arms including a first upper arm and a first lower arm, a second set of arms, the second set of arms including a second upper arm and a second lower arm, a first loader mounting plate and a second loader mounting plate, wherein the first loader mounting plate operably couples the first upper arm and the first lower arm to the attachment plate and the second loader mounting plate operably couples the second upper arm and the second lower arm to the attachment plate, a first blade mounting plate and a second blade mounting plate, wherein the first blade mounting plate operably couples the first upper arm and the first lower arm to the blade and the second blade mounting plate operably couples the second upper arm and the second lower arm to the blade, and a wheel assembly, wherein the wheel assembly is operably connected to the blade so that the wheel assembly and the blade move relative to each other in a vertical direction.

Yet another embodiment of the invention is a method for attaching an implement to an attachment plate for a vehicle. In this embodiment, the invention comprises providing at least two sets of two or more arms, each arm having a first end and a second end, and operably coupling the first end of each arm to the implement and the second end of each arm to the attachment plate, wherein the two sets of two or more arms allow the implement to be tilted such that a first side of the implement may be raised to a higher vertical position than a second side of the implement.

Other features and advantages of the apparatuses and methods of the present invention will become more fully apparent and understood with reference to the following description and drawings, and the appended claims.

BRIEF DESCRIPTION OF THE DRAWINGS

DETAILED DESCRIPTION a. General Overview and Equipment of an Embodiment of the Invention A number of embodiments of the invention are shown in FIGS. 1–13. FIGS. 1 is and 2 depict one embodiment of the attachment device 10, which is shown in FIGS. 1 and 2 attaching an implement 14 to the attachment plate 12 (the attachment plate 12 is shown in phantom lines in FIG. 1) of a vehicle. In one embodiment, the attachment device 10 includes at least two sets of two or more arms 20, each arm having a first end 40 and a second end 42, the first end 40 of each arm 20 being operably coupled to the implement 14 and the second end 42 of each arm 20 being operably coupled to attachment plate 12, wherein the two sets of two or more arms 20 allow the implement 14 to be tilted such that a first end 30 of the implement 14 may be raised to a higher vertical position than the second end 32 of the implement 14. FIG. 3 depicts a view of this embodiment of the invention, which is shown without the attachment plate 12 of the vehicle. In another embodiment, such as shown in FIGS. 1 and 2, the attachment device 10 includes a wheel assembly 16, 18, at least two sets of two or more arms 20, vehicle mounting plates 22, implement mounting plates 24, and weight transfer wedges 26. In general, in this embodiment, the two or more sets of arms 20 allow the implement 14 to be tilted such that a first end 30 of the implement 14 may be raised to a higher vertical position than a second end 32 of the implement 14.

The embodiments of the attachment device 10 of the invention may allow the implement 14 to rotate (or swivel) at a slight angle relative to the attachment plate 12. Each to set of arms 20, therefore, may operate independently so that the coupling location of that set of arms is in a different vertical position than the other set or sets of arms 20 coupled to the implement 14. When in use, therefore, one end 30 or side of the implement 14 may be tilted a significant distance (on the order of approximately 4–36 inches in one embodiment) above the other end 32 or side of the implement 14. In one embodiment, one end 30 of the implement 14 may be raised approximately 8 inches above level grade and the other end 32 of the implement 14 may be lowered approximately 8 inches below level grade. At the same time, the implement 14 may be securely coupled to the attachment plate 12 of the vehicle so that it may be used to perform its intended function. FIGS. 4 through 6 depict the embodiment of the invention of FIGS. 1 and 2 from different views.

The attachment device 10 of the invention may be used to attach an implement 14 to an attachment plate 12, which attaches to a vehicle (not shown in Figures). The vehicle may be any type of vehicle or power unit commonly used for push-type or pull-type implement applications, including skid loaders, such as Bobcat™ loaders, tractors, and the like. The attachment plate 12 may be any type of attachment plate 12 that is commonly used for connecting implements 14 to the vehicle. The implement 14 may be any type of push-type or pull-type implement commonly used, including agricultural or ground altering implements. Such implements 14 include graders or grading units, box blades, mowing blades, or any other type of industrial, farm, or ground altering implement commonly used Although the embodiment of the invention depicted in the figures shows a box blade as the implement 14, it should noted that any type of implement 14 may be used within the scope of the invention. Throughout this specification, therefore, the term "implement" will be used to broadly refer to any type of implement commonly used for industrial, far, or ground altering tasks, as well as other common applications. The individual components of some embodiments of the invention are described in more detail below.

1. The Arms

Figure 7:
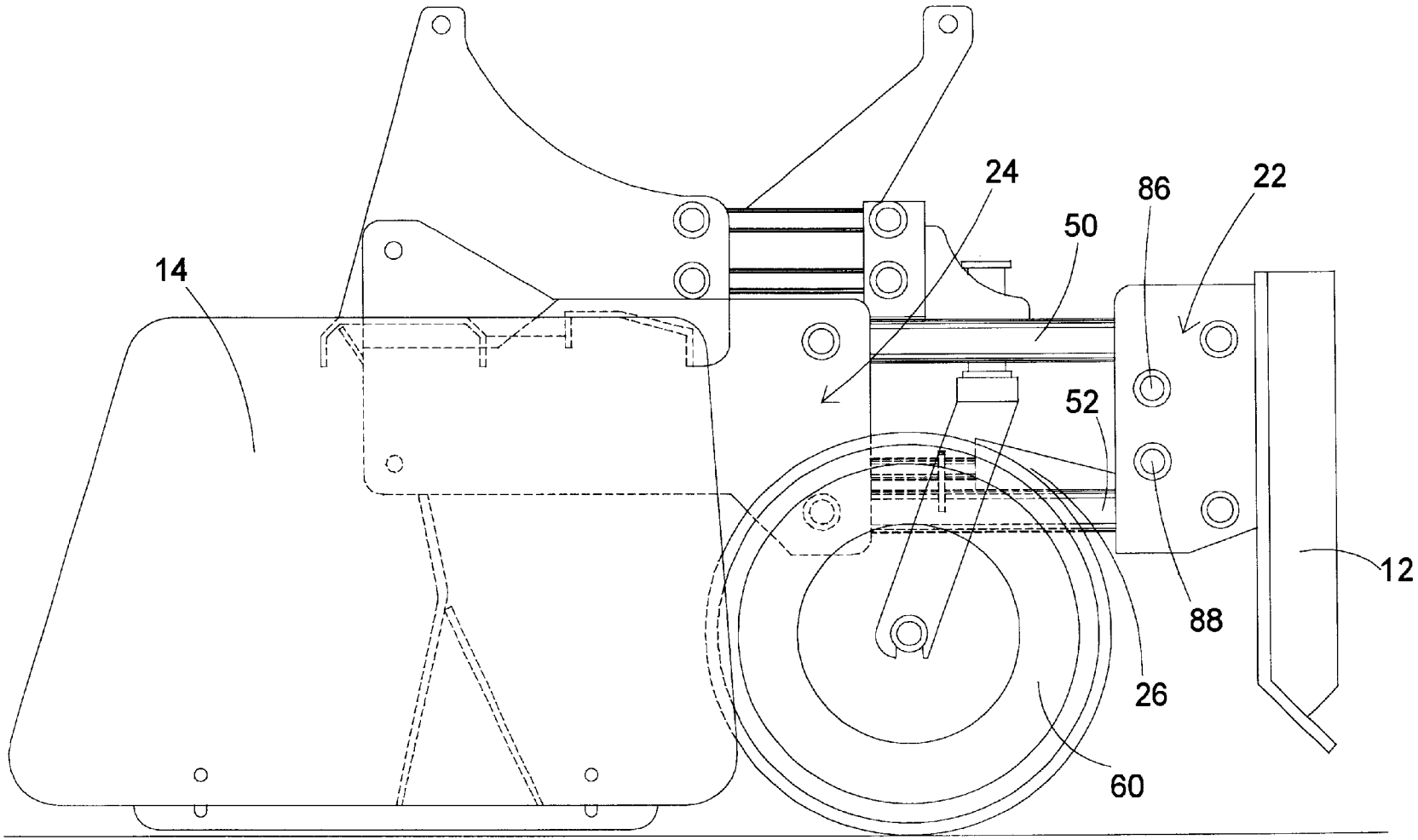
FIG. 7 is a side view of the embodiment of FIG. 1.
Figure 8:
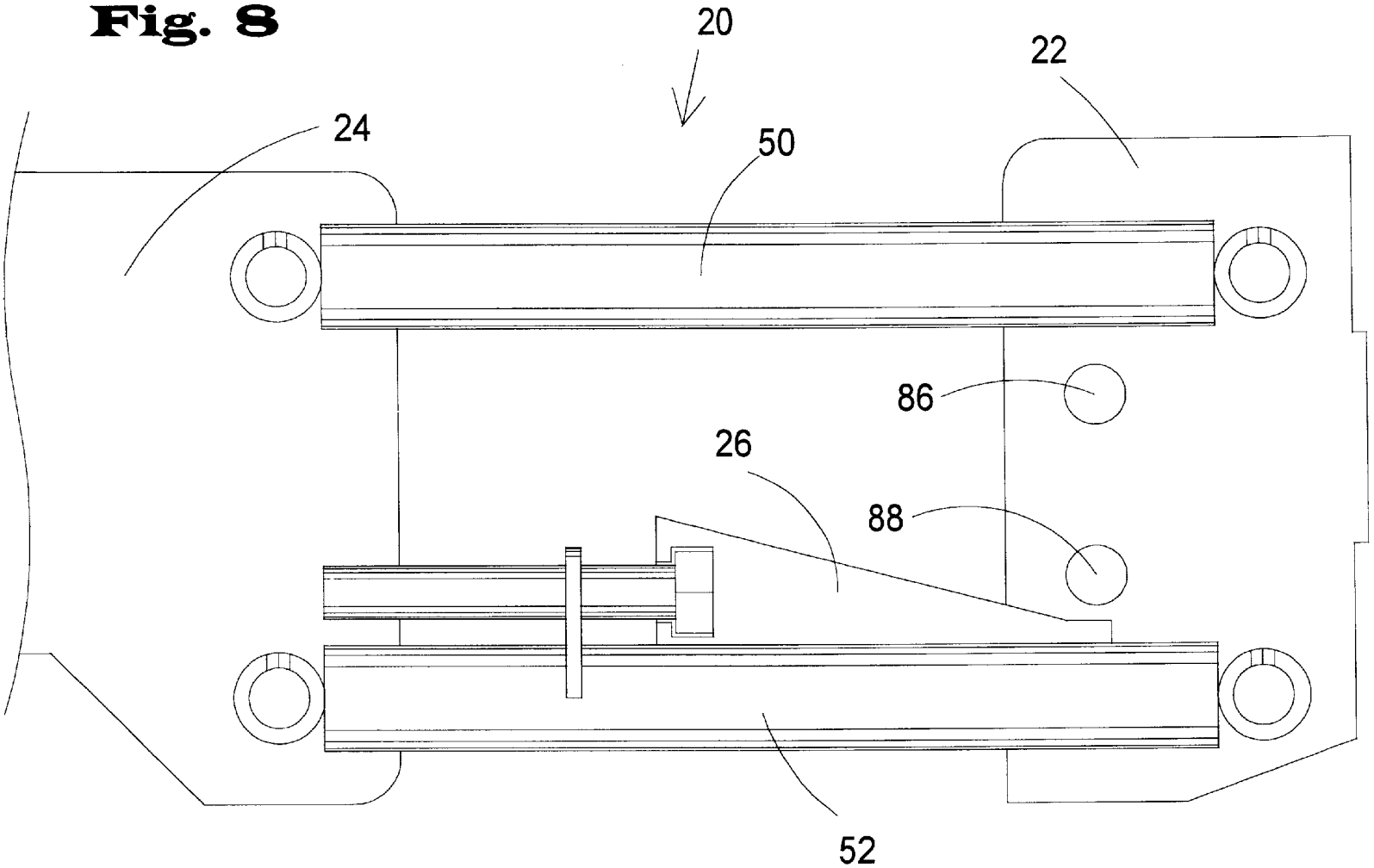
FIG. 8 is a side view of a set of two arms and connecting plates of one embodiment of the invention.
Figure 9:
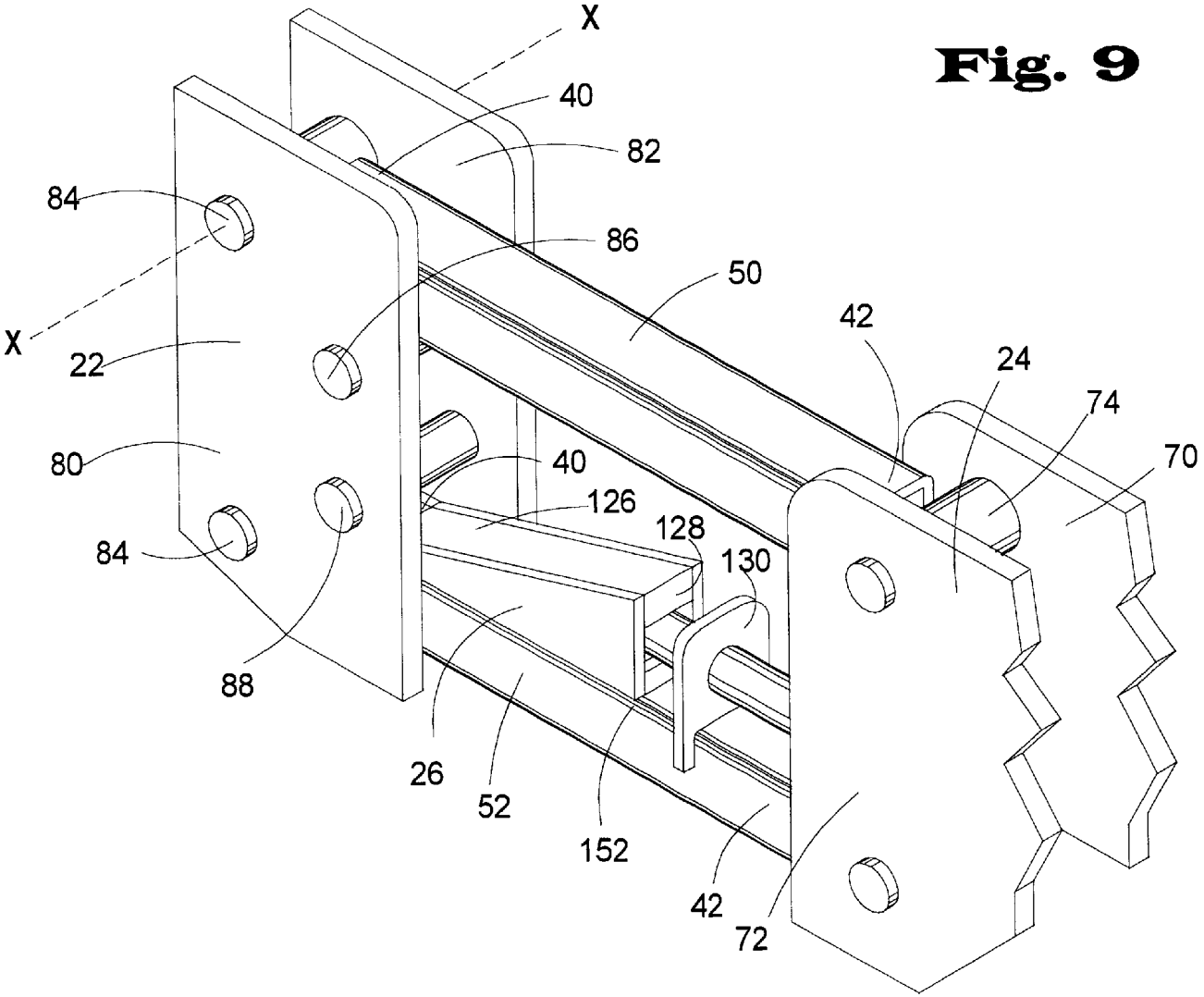
FIG. 9 is a perspective view of embodiment of the arms and connecting plates of FIG. 8.
Figure 13:
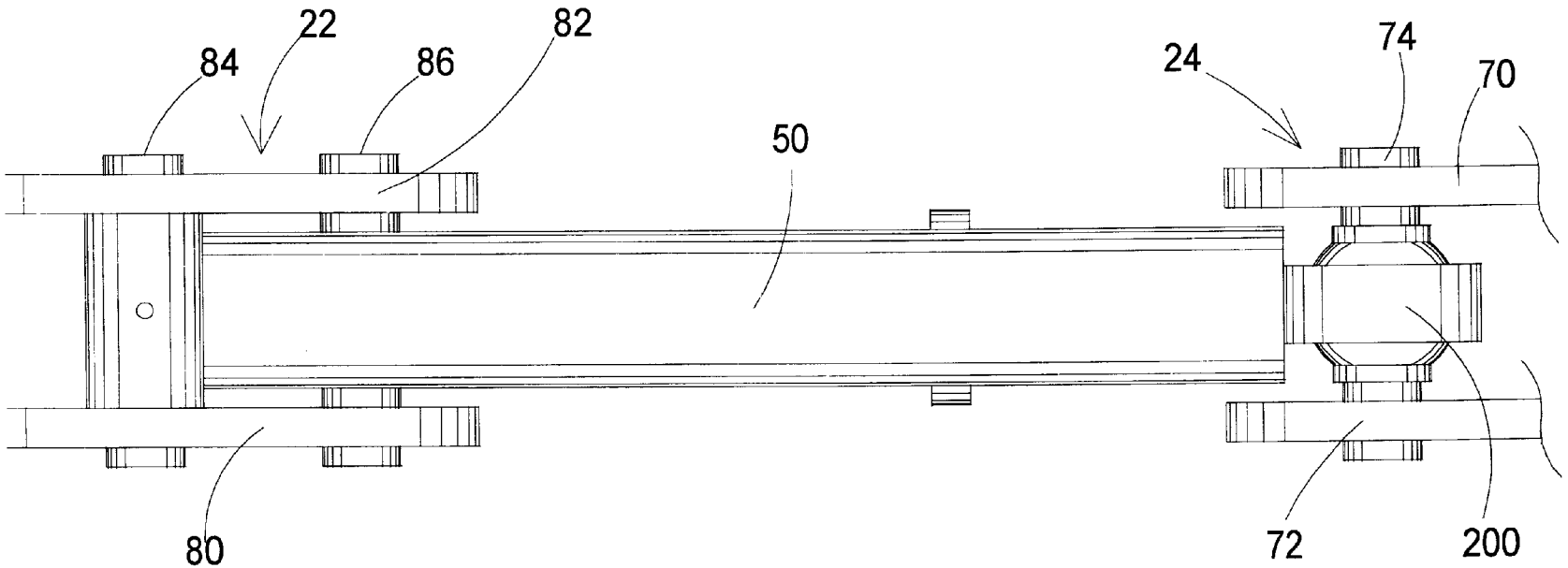
FIG. 13 is a top view the upper arm and connection of the arm to the mounting plates of one embodiment of the invention.

The arms 20 of one embodiment of the invention are shown in FIGS. 1 through 7, and in greater detail in FIGS. 8, 9, and 13. As can be seen in FIGS. 1 through 6, in one embodiment of the invention, the attachment device 10 includes at least two sets of two or more arms 20. It should be noted that each set of arms 20 may include more than two arms 20. For example, each set of arms 20 could include three or four arms 20. In addition the depicted embodiments of the invention include at least two sets of arms 20. It should also be noted that more than two sets of arms 20 may be used in some embodiments of the invention. For instance, one embodiment of the invention may utilize three or four sets of arms 20. A set of at least two arms 20 may be used in embodiments of the attachment device 10 so that the implement 14 remains in its intended orientation upon the raising or lowering of the implement 14. For instance, if only one arm 20 with a swivel connection is used to connect the implement to the attachment plate 12, the implement 14 may rotate or "roll over" upon the raising or lowering of the implement such that the bottom of the implement 14 may not be square with the ground.

Figure 1:
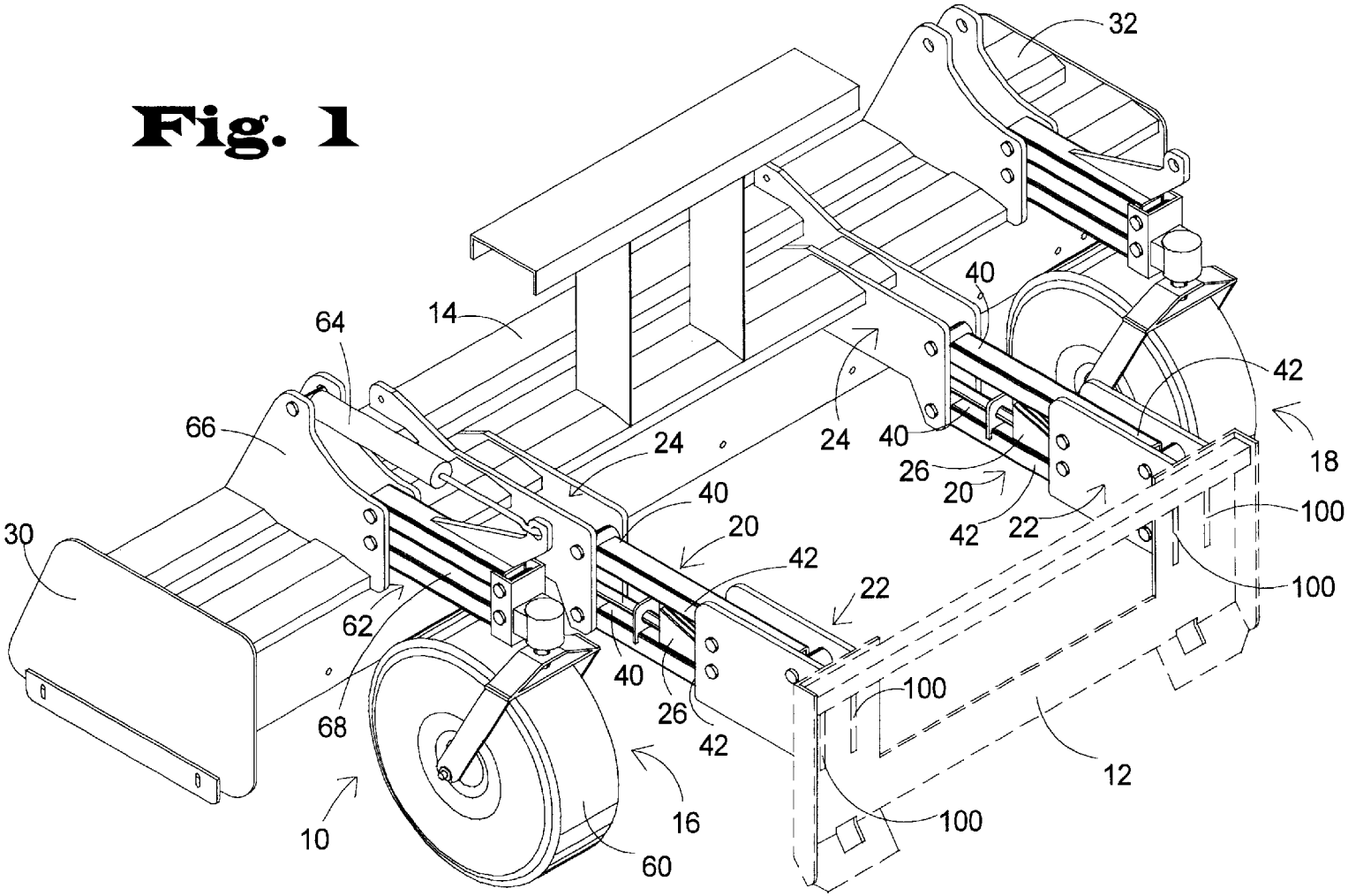
FIG. 1 is a back perspective view of one embodiment of the attachment device of the invention attaching a box blade to a connecting plate (shown in phantom lines) of a skid loader.
Figure 2:
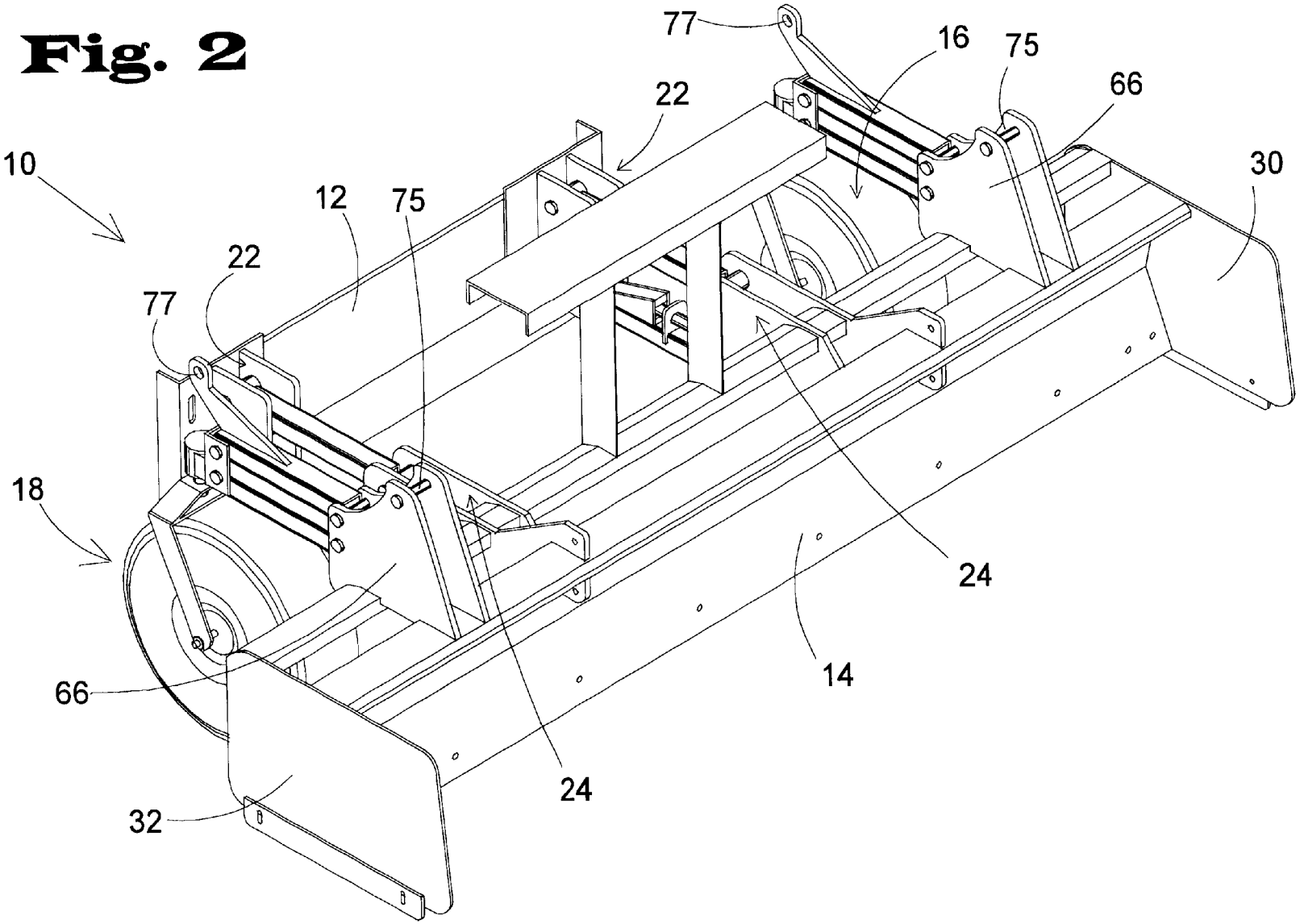
FIG. 2 is a front perspective view of the embodiment of FIG. 1.
Figure 3:
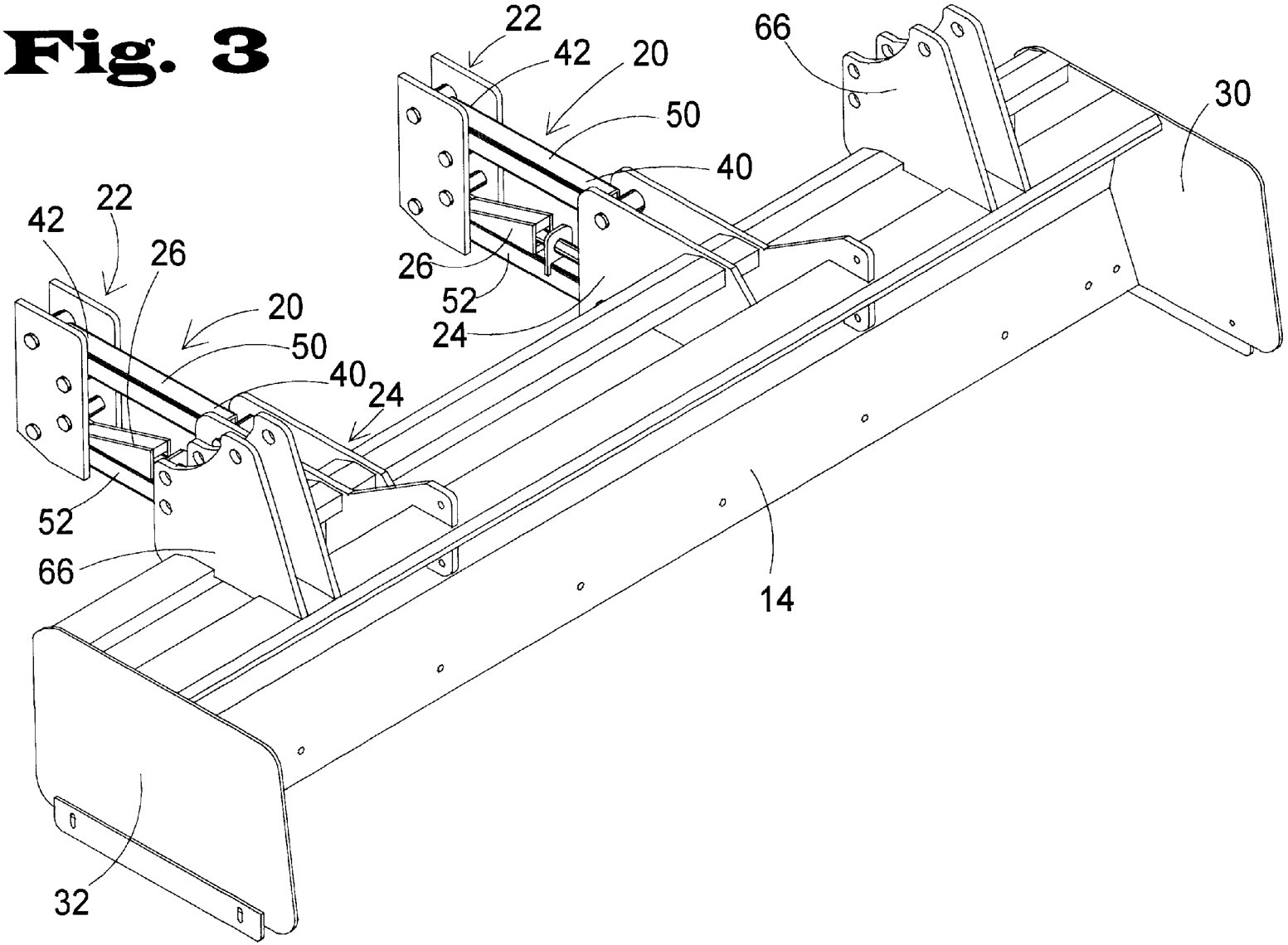
FIG. 3 is a front perspective view of the embodiment of FIG. 1 without the connecting plate or wheel assemblies of the embodiment of FIG. 1.
Figure 4:
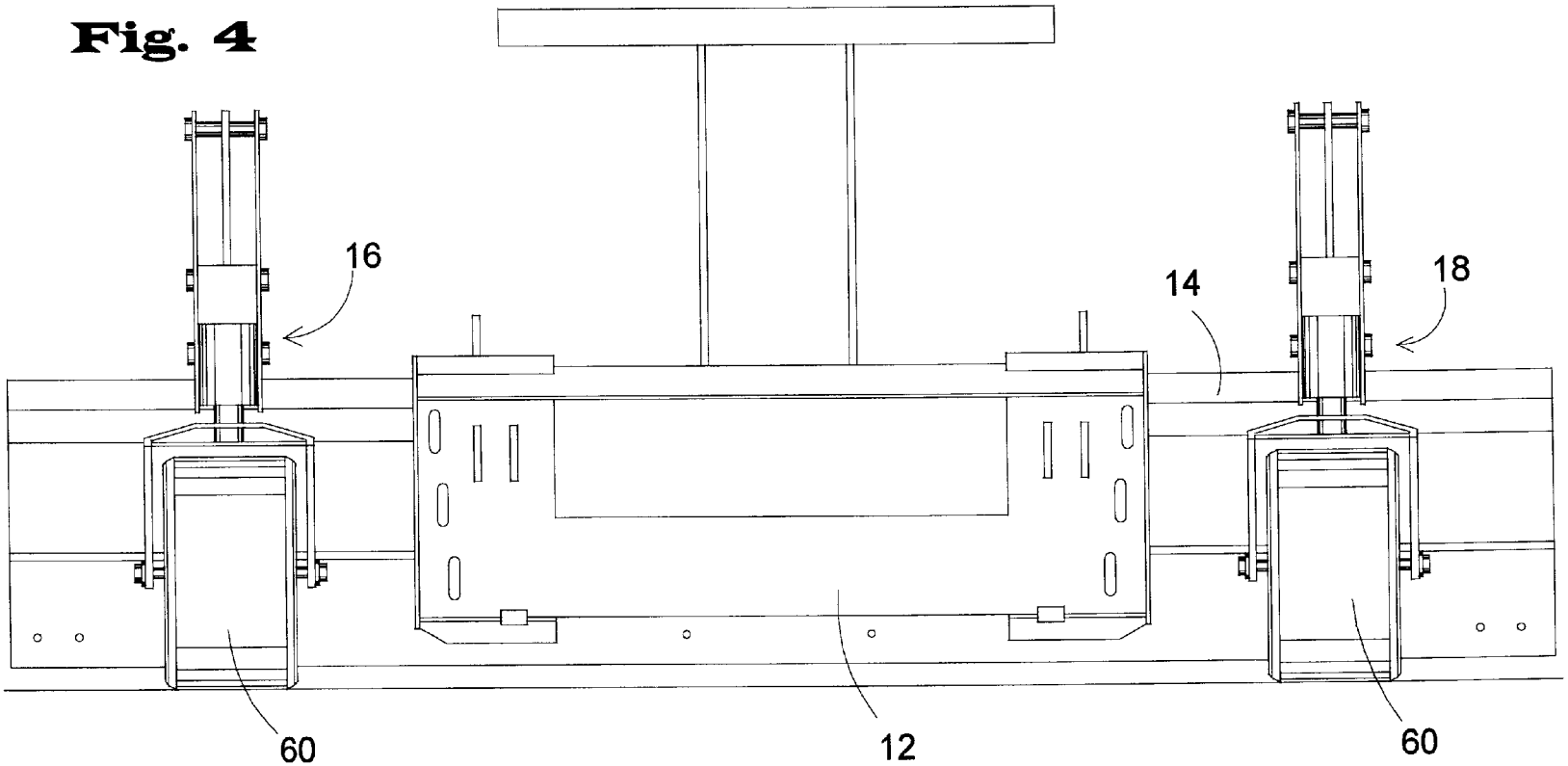
FIG. 4 is a back view of the embodiment of FIG. 1.
Figure 5:
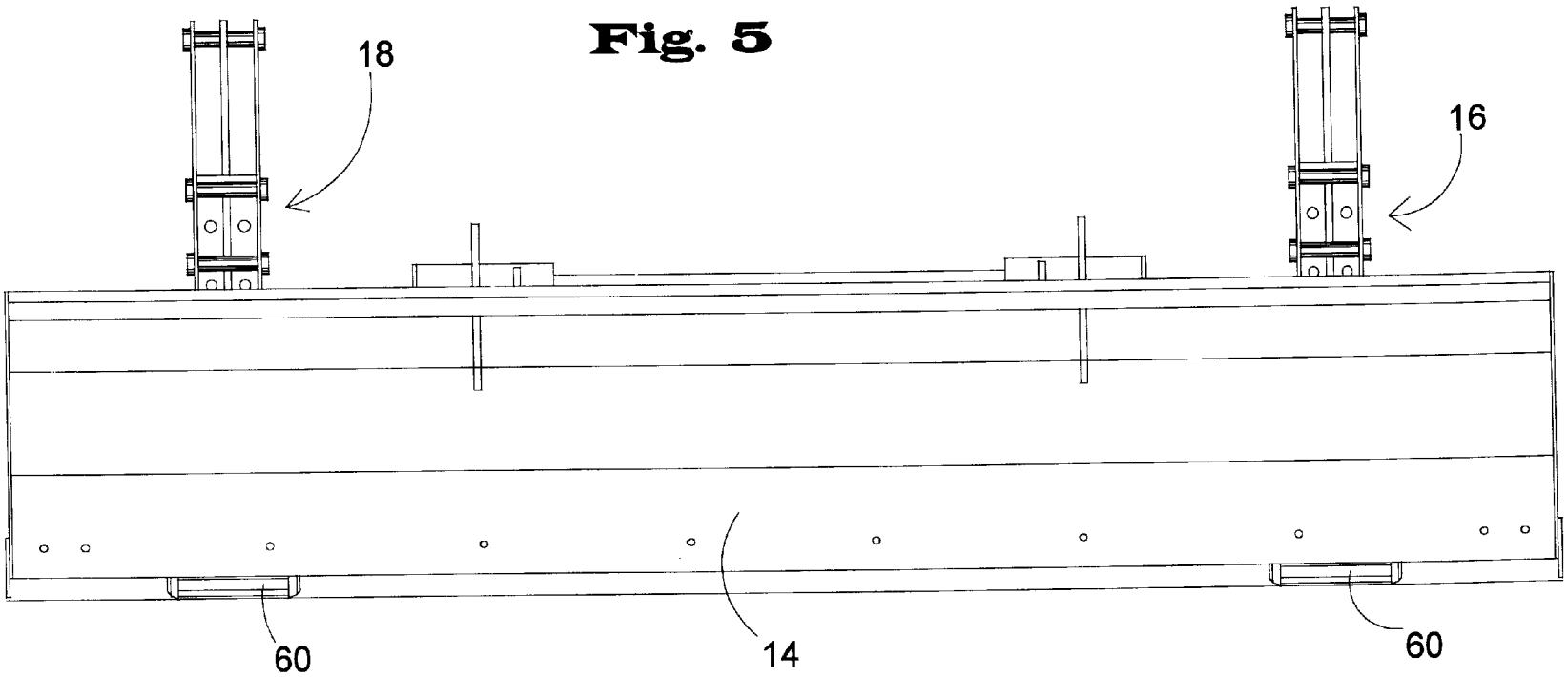
FIG. 5 is a front view of the embodiment of FIG. 1.
Figure 6:
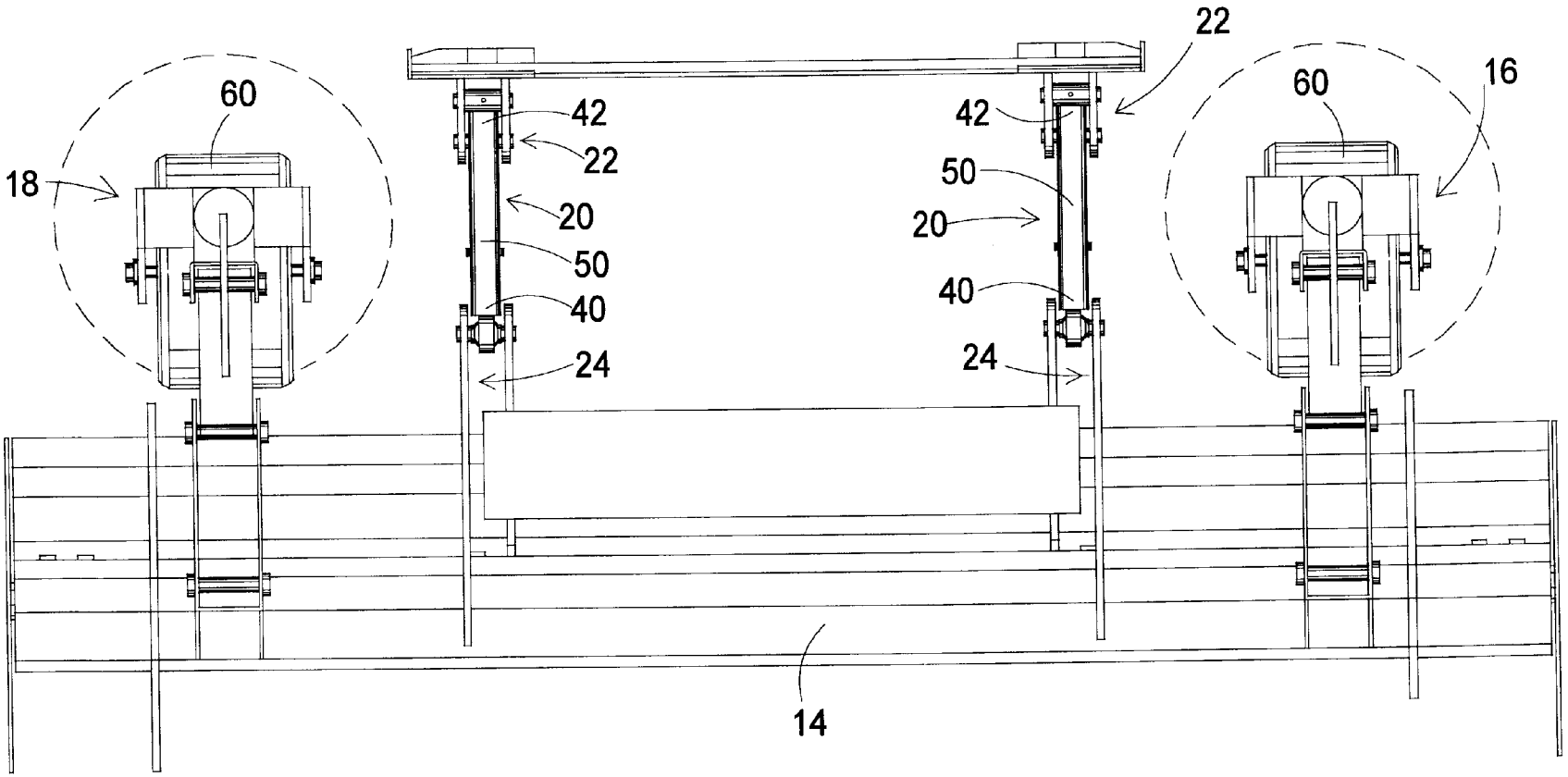
FIG. 6 is a top view of the embodiment of FIG. 1.

As can be seen in FIGS. 1 through 3, in an embodiment of the invention containing two sets of arms 20, one set of arms 20 may be located generally toward the first end 30 of the implement 14, and a second set of arms 20 may be located generally near the second end 32 of the implement 14. In other words, one set of arms 20 may attach to the implement 14 on each side 30, 32 of the implement 14. The spacing of the coupling point of the arms 20 to the implement 14 may differ widely within different embodiments of the invention. In one embodiment, the arms 20 may be coupled in close proximity to each other along the implement 14. In the embodiments of the invention depicted in the Figures, implement mounting plates 24 are used to attach the sets of arms 20 to the implement 14. Any type of device or implement mounting plate 24 may be used within the scope of the invention to attach the sets of arms 20 to the implement 14.

Referring now to FIGS. 8 and 9, in one embodiment, each set of arms 20 may include an upper arm 50 and a lower arm 52, although, as noted above, more than two arms 20 may also be used in other embodiments of the invention. The arms 50, 52 may, in one embodiment, be generally parallel arms 20 that both function in a similar manner. In one embodiment, the arms 50, 52 may be of equal length, although in other embodiments the length of the arms 50, 52 may vary. Each arm 50, 52 may be shaped in any geometry, and the arms may be made from metal, rigid plastic, or any other suitable material known to those skilled in the art. In the embodiments depicted in FIGS. 8 and 9, each arm 50, 52 is generally longitudinal and rectangular in cross-section. Each arm 50, 52 may, in other embodiments, be circular in cross-section or may have a different geometry within the scope of the invention. The length and width of each arm 50, 52 may also differ widely within the scope of the invention. Each arm 50, 52 may, in one embodiment be long enough to allow the implement 14 to be raised or lowered a sufficient distance relative to the attachment device 12, and thus each arm 50, 52 may have a sufficient length for that purpose.

As can be seen in FIGS. 8 and 9, the arms 20 may attach the attachment plate 12 to the implement 14 through the use of mounting plates 22, 24, although any type of coupling device known to those skilled in the art may be used to attach the arms 20 to the mounting plates 22, 24. Each of the arms 20 may, in one embodiment, be operably coupled to the implement 14 and attachment plate 12 through the use of any variety of rotational connections known to those skilled in the art, such that the arms may rotate about a generally horizontal axis. FIG. 9, for instance, shows one horizontal axis X—X upon which the depicted upper arm 50 may rotate about the attachment mounting plate 22. The other couplings of the arms 20 to the mounting plates 22, 24 may function in a similar fashion.

In another embodiment to the invention, at least one of the ends 40 or 42 of each arm 20 may be connected to the mounting plates 22, 24 such that the connection points may also swivel in addition to having a rotational axis. In other words, a swivel connection 200 (shown in FIG. 13) may couple the arm 20 to one or both of the mounting plates 22, 24. In one embodiment of the invention, both ends 40, 42 of each arm 20 may be connected with such a swivel connection 200 to the mounting plates 22, 24. In other embodiments, only one end 40 of each arm 20 may be coupled with a swivel connection, as specifically shown in the depiction of FIG. 13. Such a swivel connection 200 may be any type of connection known to those skilled in the art that allows the arms 20 to rotate at a slight angle to the attachment point of the mounting plate 22, 24. For instance, a ball and socket joint, such as that shown for the swivel connection 200 in FIG. 13, may be one suitable bearing that may be used in one embodiment of the invention for such a swivel connection 200. Such a ball and socket joint contains both an axis of rotation, such as that shown as X—X in FIG. 9, and it also contains a swivel connection to allow the mounting plate 24 to tilt with respect to the arm 20.

If swivel connections 200 are used on at least one end 40 of each arm 20, the implement 14 will have a range of motion such that it may be tilted with respect to the attachment plate 12, the vehicle, or the ground below the implement 14. Such a tilting action may be caused within the scope of the invention by altering the height of one end 30, 32 of the implement 14 with respect to the other end 30, 32. One method of altering this height is through the use of the wheel assemblies 16, 18 described below.

2. The Wheel Assembly

In one embodiment of the invention, the attachment device 10 includes a wheel assembly. In one embodiment, the wheel assembly includes at least two sets of wheel assemblies 16, 18. The wheel assemblies 16, 18 may be generally located between the attachment plate 12 and the implement 14. As can be seen in the embodiment of FIG. 1, the wheel assemblies 16, 18 may be located between the attachment plate 12 and the implement 14 and also on the outer edges of the sets of arms 20 (that is, toward a first outer end 30 and second outer end 32 of the implement 14). The purpose of the wheel assemblies 16, 18, in general, is to raise or lower the implement 14 with respect to the attachment plate 12 and the ground upon which the implement 14 operates, such that the implement 14 may be used for a variety of purposes. In one embodiment, one of the ends 30, 32 of the implement 14 may be raised or lowered with respect to the other end 30, 32 of the implement 14, such that the implement 14 may be raised (through the use of one or more of the wheel assemblies 16, 18) so that the implement 14 is uneven with respect to the ground upon which the implement 14 operates.

In general, each wheel assembly 16, 18 includes a wheel 60, a connecting device 62 connecting the wheel 60 to the implement 14, and an actuator 64 to raise or lower the wheel 60 with respect to at least one end 30, 32 of the implement 14. The connecting device 62 may be any type of connecting device that may connect the wheel 60 to the implement 14. In one embodiment, the connecting device 62 includes a wheel connection device 66 and a linked system 68 that allows at least one end 30, 32 of the implement 14 to be raised or lowered with respect to the wheel 60. In one embodiment, the link system 68 may contain two or more sets of arms that are similar in shape and function to the arms 20 discussed above, including the use of swivel connections with both swivel points and axis of rotation. The link system 68, therefore, may include a set of generally parallel arms that function to keep a spindle of the wheel 60 vertical so that the wheel 60 may rotate evenly during use. For instance, if one end 30, 32 of the implement 14 is raised with respect to the other end 30, 32 of the implement 14, the connection between the wheels 60 and the implement 14 may need to swivel for a smooth connection to be operable.

FIG. 1 shows one actuator 64 that may be used within the scope of the invention to raise or lower one end 30, 32 of the implement 14 with respect to the wheel 60. This actuator 64 may be any type of actuator known to those skilled in the art. One type of actuator 64 that may be used is a hydraulic cylinder with a piston that moves the connecting linkage 68 via a lever arm to raise or lower one end 30, 32 of the implement 14 with respect to the wheel 60. A pneumatic cylinder may be used as the actuator 64 in other embodiments of the invention. A first connection point 75 on the wheel connection device 66 (see FIG. 2), for instance, may be moved closer or further through use of the actuator 64 from a second connection point 77, which is located on the linkage system 68, to alter the position of the implement 14 with respect to the wheels 60. FIG. 1 shows one actuator 64, with is depicted without a supply force to activate the actuator 64. The actuator 64 may be operated manually or, in other embodiments, through the use of radio or electronic controls. The wheels 60 may also be raised off of the ground using the actuator 64, such that the entire weight of the implement 14 rests upon the ground, as may be helpful or desirable for some operations. In other embodiments, it may be useful or desirable to have the implement 14 suspended at some distance from the ground, and in still other embodiments, it may be useful or desirable to have the implement 14 tilted at an angle, as noted above.

Each wheel assembly 16, 18, as described above, may contain one or more wheel 60. It should be noted that the term "wheel" may be either a typical wheel such as the tire shown in FIG. 1, or the wheel 60 may be any other type of rolling device that may move along the ground. For instance, in one embodiment a plate (not shown) may be used instead of a wheel. Such a plate may slide along the ground during use of the attachment device 10, and at the same time, be used as a platform upon which one end 30, 32 of the implement 14 may be raised or lowered with respect to the plate.

3. The Mounting Plates

Figure 10:
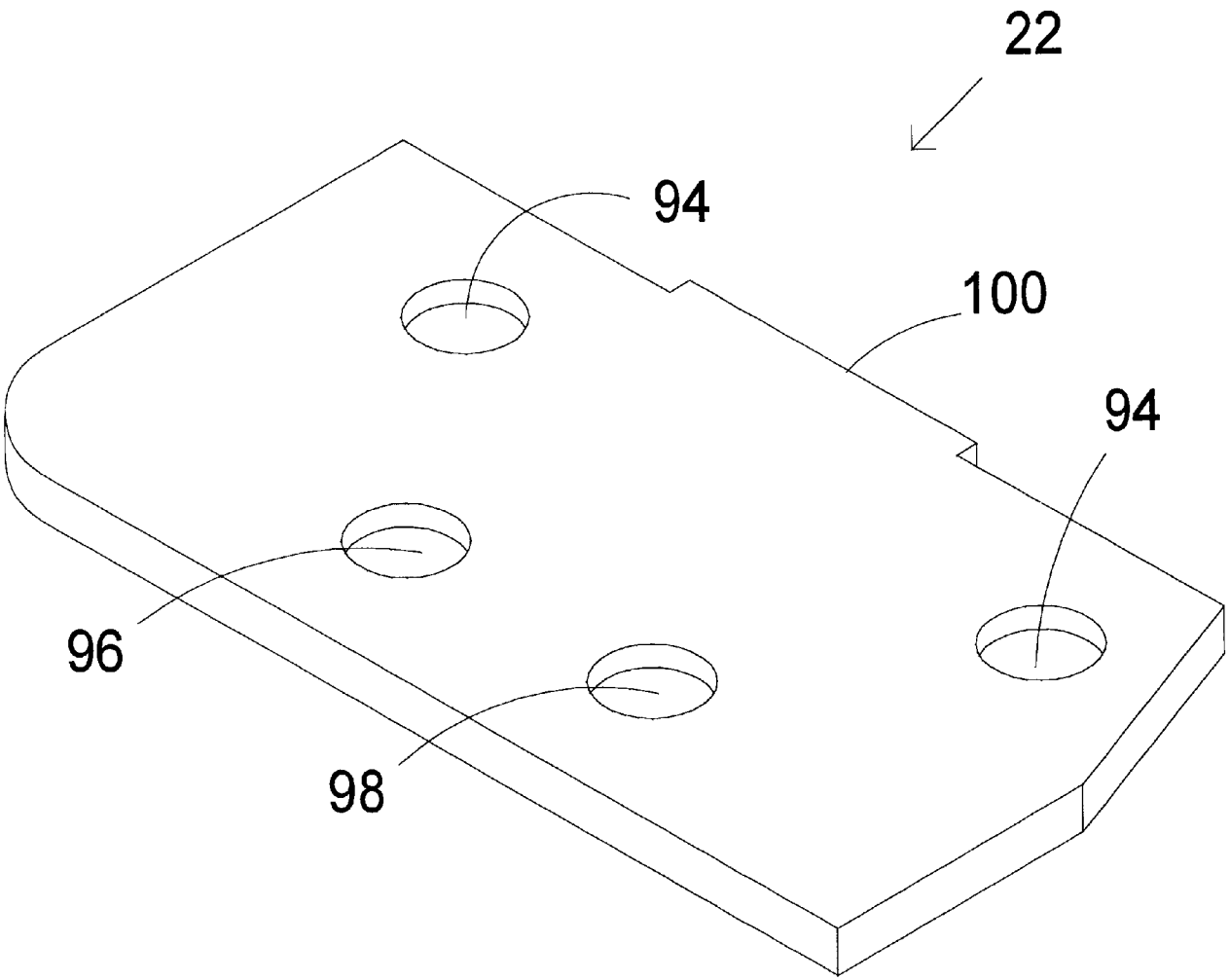
FIG. 10 is a perspective view of an embodiment of the implement mounting plate of the invention.
Figure 11:
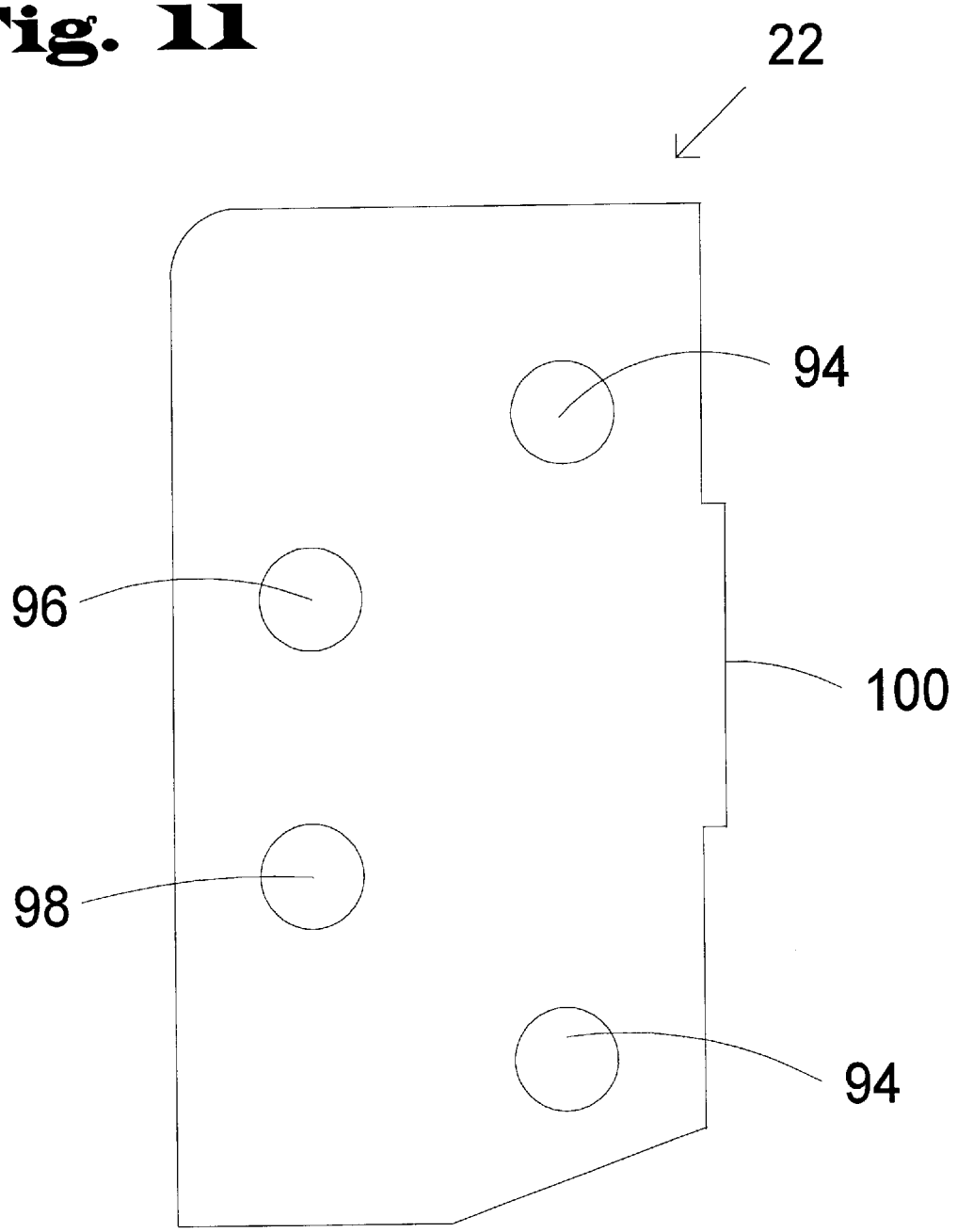
FIG. 11 is a side view of the implement mounting plate of FIG. 10.
Figure 12:
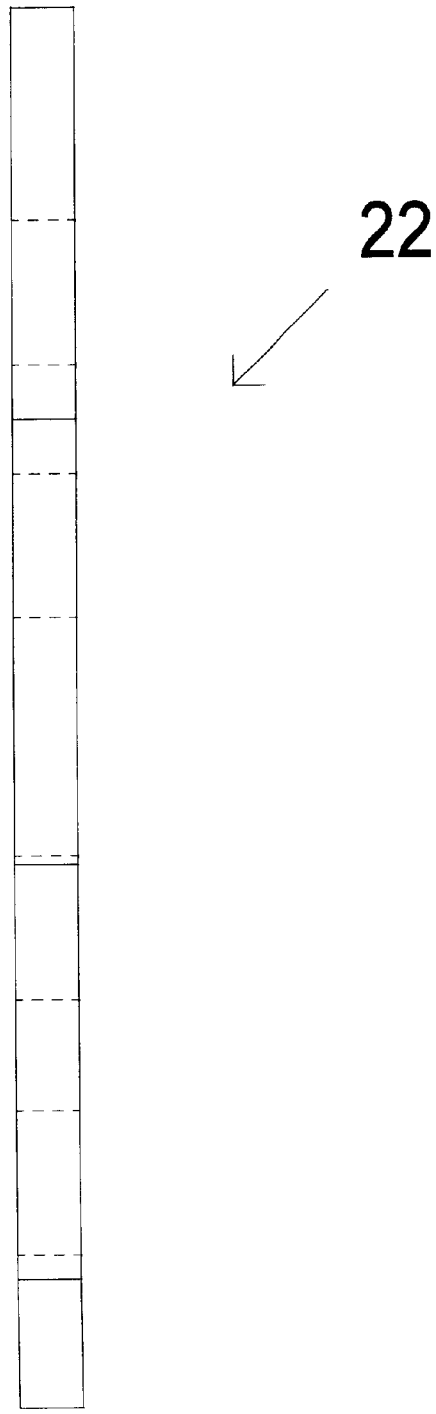
FIG. 12 is a top view of the implement mounting plate of FIG. 11.

FIGS. 8 through 9 depict embodiments of the mounting plates 22, 24 being used to connect the arms 20 to the implement 14 and the attachment plate 12, and FIGS. 10 through 12 depict one embodiment of a vehicle mounting plate 22 of the invention.

As can be seen in FIG. 1, the arms 20 of the invention may be connected to the implement 14 at a first end 40 of the arms 20 through the use of an implement mounting plate 24. The implement mounting plates 24 may generally be of any shape or geometry known to those skilled in the art. In addition, each implement mounting plate 24 may be made from any variety of materials such as metals or hard plastics known to those skilled in the art that are suitable for use with the implement 14. As can be seen partially in greater detail in FIG. 9, the implement mounting plate 24 may include a first implement plate 70 and a second implement plate 72, which are connected with rods 74. It should be noted that one rod 74 may be used for each arm 20 of the attachment device 10 of the invention. For instance, if two arms 20 are used, as shown in FIG. 9, two rods 74 may be used for the implement mounting plate 24. As shown in FIGS. 9 and 13, the rod may contain the swivel connection 200, which was discussed in greater detail above.

As FIG. 1 shows, the attachment plate 12 of the vehicle may be attached to each arm 20 with a vehicle mounting plate 22. FIGS. 8 and 9 show the vehicle mounting plate 22 in greater detail. Referring to FIG. 9, the vehicle mounting plate may include a first vehicle plate 80, a second vehicle plate 82, and rods 84 to connect the plates 80, 82. The rods 84, as shown in FIG. 9, may have a generally horizontal axis of rotation X—X, as also describe above. As noted above, the arms 20 may be connected to the rods 84 through the use of any type of bearing known to those skilled in the arts. In one embodiment, the bearing may have an axis of rotation, as shown in FIG. 9. In other embodiments, the bearing may also have a swivel connection, as also described in more detail above and shown in FIG. 13 as a connection of the arms 20 to the implement mounting plate 24. FIG. 9 also shows two secondary rods 86, 88 that also bridge between each vehicle plate 80, 82. These rods 86, 88 may have any type of geometry typically used for such rods, such as circular cross-sections or rectangular cross-sections, and the rods 86, 88 may be made from any suitable material, such as a metal or a hard plastic. The purpose of these rods 86, 88 is to serve as a stop when the arms 20 of the attachment device 10 swivel upward or downward upon the raising or lowering of the implement 14. Referring now to FIGS. 7 and 8, it can be seen that if an implement mounting plate 24 (and therefore also the implement 14) is raised with respect to the vehicle mounting plate 22 (and hence the attachment plate 12 of the vehicle), the secondary rods 86, 88 may serve as stops. For instance, if the implement mounting plate 24 is raised with respect to the vehicle mounting plate 22, the lower secondary rod 88 will serve as a stop that will end the range of motion of the implement mounting plate 24. On the other hand, if the implement mounting plate 24 is lowered with respect to the vehicle mounting plate 22, the upper secondary rod 86 will serve as a stop to complete the range of motion of implement mounting plate 24, and hence the implement 14.

The geometry of one embodiment of the vehicle mounting plate 22 is shown in greater detail in FIGS. 10 through 12. As can be seen in FIGS. 10 and 11, each plate 80, 82 of the vehicle mounting plate 22 may have a generally rectangular shape and may have a somewhat thin thickness. It should be noted however, that any variety of geometries may be used for each plate 80, 82 of the vehicle mounting plate 22, and that FIGS. 10 through 12 depict only one possible embodiment of these plates 80, 82. As FIGS. 10 through 11 show, each plate 80, 82 of the vehicle mounting plate 22 may contain a number of holes as shown in the drawings. In general, each vehicle mounting plate 22 may contain one mounting hole 94 for each rod upon which an arm 20 connects. For instance, if three arms 20 are used for each set of arms 20, each vehicle mounting plate 22 may have three such holes 94. The embodiment of the vehicle mounting plates 22 shown in FIGS. 10 and 11 is designed for a set of two arms 20, and thus contains two holes 94. Each vehicle mounting plate 22 may also contain the two holes 96, 98 upon which the rods 86, 88 may be mounted.

The vehicle attachment plates may be operably coupled to the attachment plate 12 of the vehicle through any method known to those skilled in the art. As can be seen in FIGS. 10 and 11, each plate 22 of the vehicle mounting plate 22 may contain a notched portion 100 which may be used for connection to the attachment plate 12. Referring now to FIG. 1, these notched connections 100 may be seen connecting the vehicle mounting plates 22 to the attachment plate 12. This attachment can be accomplished through any type of method known to those skilled in the art, including welding or riveting. It should also be noted that the implement mounting plates 24 may be connected using any type of connection known to those skilled in the art, including riveting or welding.

4. The Wedges

As noted above, the attachment device 10 may also contain one or more wedges 26 that may be used to transfer force or pressure to the implement 14 from the vehicle. As can best be seen in FIGS. 7 through 9, one wedge 26 may be used for each set of arms 20. For instance, in FIGS. 7 through 9 two sets of arms 50, 52 are used, and one wedge 26 may be used for each set of arms 50, 52. It may also be noted that more than one wedge 26 may be used for each set of arms 20 in other embodiments of the invention. A purpose of the wedges 26 is to slide with respect to one arm 50, 52 of each set of arms 20, and thus be used to alter the position of the implement mounting plate 24 with respect to the vehicle mounting plate 22, therefore transferring force from the vehicle to the implement 14. In other words, the attachment plate 12 may be raised with respect to the implement 14, thus applying a downward force on the implement 14. In an embodiment in which the implement 14 is a cutting edge or blade, for instance, it may be desirable to apply a constant, even downward force on the cutting edge to manipulate the surface below the cutting edge.

Referring now to the embodiment shown FIGS. 7 through 9, one wedge 26 is depicted placed upon a lower arm 52 of each set of arms 20. The wedge 26 is generally ramp-shaped or, in other words, triangular shaped. The wedge 26 may be positioned along the upper surface 152 of the lower arm 52 of the set of arms 20, as can best be seen in FIG. 9. The wedge 26 may be positioned along the lower arm 52 generally closer to the vehicle mounting plate 22 than to the implement mounting plate 24. The thicker end 128 of the wedge 26, therefore may be positioned closer to the implement mounting plate 24 than to the vehicle mounting plate 22. The wedge 26 may be slidably connected along the upper surface 152 of the lower arm 52. A stop 130 may be used to fix the position of the wedge 26 between the implement mounting plate 24 and the vehicle mounting plate 22. In order to transfer force from the vehicle to the implement 14, the wedge 26 may be slided along the upper surface 152 of the lower arm 52 toward the vehicle mounting plate 22, and then fixed in position with the stop 130. Because the wedge 26 may be ramp-shaped, after the wedge 26 has been moved toward the vehicle mounting plate 22, the implement mounting plate 24 will be in a lower position with respect to the vehicle mounting plate 22 than before the wedge 26 was shifted. Because the vehicle mounting plate 22 may be connected to the attachment plate 12 of the vehicle, and this attachment plate 12 and vehicle may be fixed in a vertical position, the implement mounting plate 24, and hence the implement 14, will be in a lower position with respect to the attachment plate 12 than before the shift of the wedge 26.

As can be seen in FIG. 1, each set of arms 20 may contain a wedge 26 along one of the arms in each set of arms 20. In one embodiment these wedges 26 may be moved in tandem to shift or apply a force or reduce a force to the implement 14, although in other embodiments one of the wedges 26 may be shifted without a shift of the wedge 26 on another set of arms 20 of the attachment device 10. The wedge 26 may be made from any material known to those skilled in the arts that is suitable for the stresses that may be placed upon it, including metals and/or plastics.

b. Operation

In one embodiment of a method of the invention, at least two sets of two or more arms 20 may be provided, and the first end 40 of each of these arms 20 may be operably coupled to the implement 14 and the second end 42 of each arm 20 may be operably coupled to the attachment plate 12, and the two sets of two or more arms 20 may allow the implement 14 to be tilted such that a first side 30 of the implement 14 may be raised to a higher vertical position than a second side 32 of the implement 14. The wheel assemblies 16, 18 of the attachment device 10 may be used to raise or lower one end 30, 32 or both ends 30, 32 of the implement 14. After the wheel assemblies 16, 18 are used to alter the height of one or both ends 30, 32 of the implement 14, the wedges 26 may be shifted in order to transfer weight to or transfer force from the vehicle to the implement 14. Because, in one embodiment of the invention, the arms 20 are operably coupled with swivel connections 200 to the implement 14, the implement 14 may be tilted (that is to say, one end 30, 32 may be raised or lowered with respect to the other end 30, 32 of the implement 14), the implement 14 may be used on uneven surfaces or may be used to create an uneven landscaping of the ground upon which it operates.

C. Conclusion

The attachment devices and methods of the invention described above provide numerous benefits over typical attachment devices. One advantage of an embodiment of the present invention as described above is that it enables one end 30, 32 of the implement 14 to be raised or lowered with respect to the other end 30, 32 of the implement 14 in a simple fashion.

Another advantage of the above embodiments of the invention is that the attachment device 10 allows the implement 14 to be simply connected to the vehicle in a manner that allows the vehicle to remain maneuverable, easy, and comfortable to drive. Some typical attachment devices used in the art, including that disclosed in the Van Ornum patent, for instance, may cause the implement to extend from eight to ten feet from the front of the vehicle. Because the attachment device 10 of the invention is designed to be space-efficient, the attachment device 10 may cause the implement 14 to be on the order of only three to four feet beyond the front of the vehicle (or the attachment plate 12 of the vehicle). In other embodiments, the implement 14 may be only approximately forty inches beyond the vehicle or attachment plate 12 of the vehicle. The arms 20 of the invention, therefore, may be appropriately sized to keep the implement 14 in close proximity to the vehicle.

The accompanying Figures depict embodiments of the attachment devices 10 of the present invention, and features and components thereof. With regard to means for fastening, mounting, coupling, attaching or connecting components of the present invention to form an embodiment of the invention as a whole, unless specifically described otherwise, such means are intended to encompass conventional fasteners such as machine screws, machine threads, seals, snap rings, clamps, rivets, nuts and bolts, toggles, pins and the like, and bearings. Components may also be connected adhesively, by friction fitting, or by welding or deformation, if appropriate. Unless specifically otherwise disclosed or taught, materials for making components of the present invention are selected from appropriate materials such as metal, metallic alloys, stainless steel, natural or synthetic materials, plastics and the like, either rigid or soft, and appropriate manufacturing or production methods including casting, extruding, molding and machining may be used. In addition, any type of bearings known to those skilled in the art may be used within the scope of the invention, including any type of ball and socket joint. The dimensions of the components of the invention may also vary widely without departing from the scope of the invention.

Any references to front and back, right and left, top and bottom, upper and lower, and horizontal and vertical are intended for convenience of description, not to limit the present invention or its components to any one positional or spacial orientation. All dimensions of the components in the attached Figures may vary with a potential design and the intended use of an embodiment of the invention without departing from the scope of the invention.

While the present invention has been described with reference to several embodiments thereof, those skilled in the art will recognize various changes that may be made without departing from the spirit and scope of the claimed invention. Accordingly, this invention is not limited to what is shown in the drawings and described in the specification but only as indicated in the appended claims.

What is claimed is:

1. An attachment device for attaching an implement to an attachment plate for a vehicle, comprising:

at least two sets of two or more arms, each arm having a first end and a second end, the first end of each arm being operably coupled to the implement and the second end of each arm being operably coupled to the attachment plate, wherein at least one end of each arm has a swivel connection such that the two sets of two or more arms allow the implement to be tilted about an axis extending between the implement and the attachment plate to permit a first end of the implement to be raised to a higher vertical position than a second end of the implement.

2. The attachment device of claim 1, wherein the axis extending between the implement and the attachment plate is oriented substantially perpendicular to the attachment plate.

3. The attachment device of claim 1, wherein each end of each arm has a swivel connection.

4. The attachment device of claim 1, wherein each arm is of equal length.

5. The attachment device of claim 1, further comprising a vehicle mounting plate for each set of arms to operably couple the second end of each arm to the attachment plate.

6. The attachment device of claim 5, further comprising an implement mounting plate for each set of arms to operably couple the first end of each arm to the implement.

7. The attachment device of claim 5, wherein the swivel connection operably couples the second end of each arm to the vehicle mounting plates.

8. The attachment device of claim 6, wherein the swivel connection operably couples the first end of each arm to the implement mounting plates.

9. The attachment device of claim 8, wherein each implement mounting plate comprises a left plate and a right plate connected to each other with rods, wherein the swivel connections couple each arm to the rods, and wherein a connection section of each implement mounting plate connects the implement mounting plate to the implement.

10. The attachment device of claim 9, further comprising a wedge on at least one arm of each set of arms, wherein a position of the wedge may be altered to apply a downward force on the implement.

11. The attachment device of claim 9, further comprising a wheel system to raise or lower the first end or the second end of the implement.

12. The attachment device of claim 11, wherein the wheel system comprises a first wheel and a second wheel, the first wheel being operably coupled to the implement near the first end of the implement and the second wheel being operably coupled to the implement on the second end of the implement, and wherein an actuator is coupled to each wheel and the implement to raise or lower the first end or the second end of the implement with respect to the wheel system.

13. The attachment device of claim 12, wherein each actuator is a hydraulic cylinder and actuator.

14. An attachment device for attaching a blade to an attachment plate for a loader, comprising:

(a) a first set of arms, the first set of arms including a first upper arm and a first lower arm;

(b) a second set of arms, the second set of arms including a second upper arm and a second lower arm;

(c) a first loader mounting plate and a second loader mounting plate, wherein the first loader mounting plate operably couples the first upper arm and the first lower arm to the attachment plate and the second loader mounting plate operably couples the second upper arm and the second lower arm to the attachment plate;

(d) a first blade mounting plate and a second blade mounting plate, wherein the first blade mounting plate operably couples the first upper arm and the first lower arm to the blade and the second blade mounting plate operably couples the second upper arm and the second lower arm to the blade;

(e) wherein the wheel assembly is operably connected to the blade so that the wheel assembly and the blade move relative to each other in a vertical direction; and (f) wherein the wheel assembly comprises a first wheel assembly and a second wheel assembly, wherein each wheel assembly is on an opposite side of the blade.

15. The attachment device of claim 14, wherein each wheel assembly comprises a wheel, a connecting device connecting the wheel to the blade, and an actuator to raise and lower the wheel with respect to one side of the blade.

16. The attachment device of claim 14, further comprising a first wedge and a second wedge, wherein the first wedge is located on one of the first set of arms and the second wedge is located on one of the second set of arms, wherein the first wedge and the second wedge may be shifted in position to apply a downward force on the blade.

17. An attachment device for attaching an implement to an attachment plate for a vehicle, comprising:

at least two sets of two or more arms, each arm having a first end and a second end, the first end of each arm being operably coupled to the implement and the second end of each arm being operably coupled to the attachment plate, wherein the two sets of two or more arms allow the implement to be tilted such that a first end of the implement may be raised to a higher vertical position than a second end of the implement;

a vehicle mounting plate for each set of arms to operably couple the second end of each arm to the attachment plate;

an implement mounting plate for each set of arms to operably couple the first end of each arm to the implement;

a swivel connection to operably couple the first end of each arm to the implement mounting plates; and wherein each implement mounting plate comprises a left plate and a right plate connected to each other with rods, wherein the swivel connections couple each arm to the rods, and wherein a connection section of each implement mounting plate connects the implement mounting plate to the implement.

18. The attachment device of claim 17, further comprising a wedge on at least one arm of each set of arms, wherein a position of the wedge may be altered to apply a downward force on the implement.

19. The attachment device of claim 17, further comprising a wheel system to raise or lower the first end or the second end of the implement.

20. The attachment device of claim 19, wherein the wheel system comprises a first wheel and a second wheel, the first wheel being operably coupled to the implement near the first end of the implement and the second wheel being operably coupled to the implement on the second end of the implement, and wherein an actuator is coupled to each wheel and the implement to raise or lower the first end or the second end of the implement with respect to the wheel system.

21. The attachment device of claim 20, wherein each actuator is a hydraulic cylinder and actuator.

22. An attachment device for attaching a blade to an attachment plate for a loader, comprising:

(a) a first set of arms, the first set of arms including a first upper arm and a first lower arm;

(b) a second set of arms, the second set of arms including a second upper arm and a second lower arm;

(c) a first loader mounting plate and a second loader mounting plate, wherein the first loader mounting plate operably couples the first upper arm and the first lower arm to the attachment plate and the second loader mounting plate operably couples the second upper arm and the second lower arm to the attachment plate;

(d) a first blade mounting plate and a second blade mounting plate, wherein the first blade mounting plate operably couples the first upper arm and the first lower arm to the blade and the second blade mounting plate operably couples the second upper arm and the second lower arm to the blade;

(e) a first wedge and a second wedge, wherein the first wedge is located on one of the first set of arms and the second wedge is located on one of the second set of arms, wherein the first wedge and the second wedge may be shifted in position to apply a downward force on the blade; and (f) wherein the wheel assembly is operably connected to the blade so that the wheel assembly and the blade move relative to each other in a vertical direction.

23. The attachment device of claim 22, wherein each wheel assembly comprises a wheel, a connecting device connecting the wheel to the blade, and an actuator to raise and lower the wheel with respect to one side of the blade.

24. A method for attaching an implement to an attachment plate for a vehicle, comprising:

(a) providing at least two sets of two or more arms, each arm having a first end and a second end;

(b) operably coupling the first end of each arm to the implement and the second end of each arm to the attachment plate, wherein at least one end of each arm has a swivel connection such that the two sets of two or more arms allow the implement to be tilted about an axis extending between the implement and the attachment plate to permit a first side of the implement to be raised to a higher vertical position than a second side of the implement.

* * * * *